US005314361A

United States Patent [19]

Ney et al.

[11] Patent Number: 5,314,361

[45] Date of Patent: May 24, 1994

[54] ELECTRICAL CONTACT WITH RECESSED WIRE CONNECTING PORTION

[75] Inventors: Reuben E. Ney, Mount Joy; Kenneth E. Markle, York; William E. Zelko, Dauphin, all of Pa.

[73] Assignee: The Whitaker Corporation, Wilmington, Del.

[21] Appl. No.: 870,725

[22] Filed: Apr. 15, 1992

Related U.S. Application Data

[63] Continuation of Ser. No. 694,627, May 2, 1991, abandoned.

[51] Int. Cl.[5] ..... H01R 4/02

[52] U.S. Cl. ..... 439/874

[58] Field of Search ..... 439/877, 880, 874, 875

[56] References Cited

U.S. PATENT DOCUMENTS

| | | | |
|---|---|---|---|
| 2,354,081 | 7/1944 | Weder | 439/877 |
| 2,550,578 | 4/1951 | McBerty | 439/877 |
| 4,681,382 | 7/1987 | Lockard | 439/92 |
| 4,687,264 | 8/1987 | Shuey | 439/92 |
| 4,690,647 | 9/1987 | Hamsher, Jr. et al. | 439/92 |
| 4,984,992 | 1/1991 | Beamenderfer et al. | 439/108 |
| 5,044,999 | 9/1991 | Brandeau | 439/877 |

*Primary Examiner*—Gary F. Paumen

[57] ABSTRACT

An electrical contact, comprises, a wire connecting portion 16, 17 of the contact constructed for being overlaid by a corresponding electrical wire and for being welded to the corresponding wire by welding electrodes of a welding apparatus, a top surface 20 of the contact having an elongated recess 22 recessed toward the bottom surface 21 for cradling the corresponding wire, and the bottom surface 21 lacking deformation outwardly by formation of the recess 22 in the top surface 20.

6 Claims, 3 Drawing Sheets

ELECTRICAL CONTACT WITH RECESSED WIRE CONNECTING PORTION

This application is a continuation of application Ser. No. 07/694,627 filed May 2, 1991, now abandoned.

FIELD OF THE INVENTION

The invention pertains to an electrical contact having a wire connecting portion to which a wire is connected by a welding operation.

BACKGROUND OF THE INVENTION

As disclosed in U.S. Pat. No. 4,984,992, an electrical connector comprises, an insulative housing block, electrical contacts spaced apart along the housing block, and wire connecting portions of the contacts constructed for being overlaid by corresponding electrical wires and for being welded to the corresponding wires by welding electrodes of a welding apparatus.

The wire connecting portion of each of the contacts is thin and flat, having been cut from a sheet of metal. The wire and the wire connecting portion are clamped between the electrodes during the welding operation. It is important to maintain the wire in position with respect to the wire connecting portion prior to being clamped by the electrodes. If the wire is dislodged from its position, the wire can be connected ineffectively, or not at all, to the wire connecting portion.

Although the wire connecting portion is capable of being connected to wires of both solid wire construction and stranded wire construction, it is the stranded wire construction that is more difficult to maintain in position with respect to the wire connecting portion. A stranded wire, a wire having multiple wire strands, is limp and less stiff than a solid wire, and is more apt to be dislodged from its position with respect to the wire connecting portion. The strands tend to unravel and would lack confinement within a weld joint formed between the wire and the electrical contact.

According to U.S. Pat. No. 4,690,647, to hold a wire in position, an electrical contact is formed with upturned portions that grip the wire. Although such a construction effectively grips the wire, the upturned portions are not readily adapted for welding by electrodes. The upturned portions would deform under electrical current and pressure, applied by the electrodes during a welding operation, which could render the welding operation ineffective, or which could require the welding operation to vary unless the welding operation were skillfully performed to account for variations in the deformity resulting from the applied electrical current and pressure.

SUMMARY OF THE INVENTION

According to the invention, a wire connecting portion of an electrical contact is recessed to cradle an electrical wire of solid or stranded construction, to enhance the positioning of the wire prior to being weld joined to the contact. A feature of the invention resides in the absence of a deformity in the bottom surface of a the contact which would interfere with effectiveness of the welding operation.

According to the invention, an electrical contact, comprises, a wire connecting portion of the contact constructed for being overlaid by a corresponding electrical wire and for being welded to the corresponding wire by welding electrodes of a welding apparatus, a top surface of the contact having an elongated recess recessed toward the bottom surface for cradling the corresponding wire, and a bottom surface of the wire connecting portion lacking deformation outwardly by formation of the recess in the top surface. Thereby, the bottom surface has a shape for conforming abutment with a corresponding weld electrode to assure good electrical contact therebetween, and to reduce variations in deformity of the parts to be weld joined.

An understanding of the invention will be described by way of example with reference to the following detailed description of a preferred embodiment taken in conjunction with accompanying drawings, according to which;

DETAILED DESCRIPTION

Figure 1:
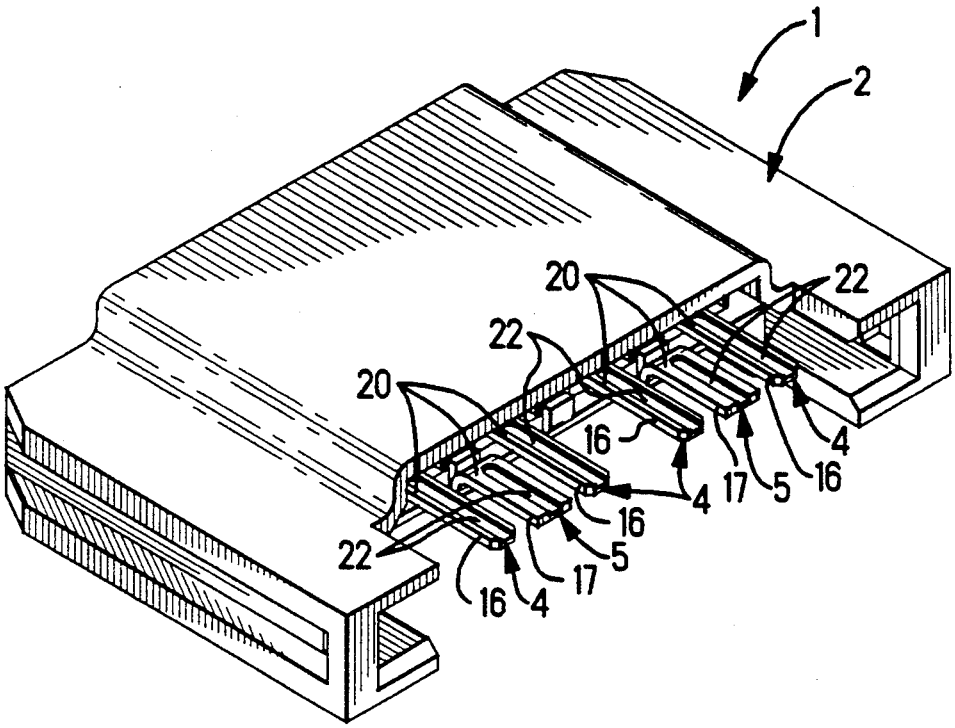
FIG. 1 is a perspective view of an electrical connector for connection to electrical wires.

With reference to FIGS. 1, 2, 5 and 6 of the drawings, an electrical connector 1 in the form of a cable connector comprises, a housing block 2, at least one electrical cable 3 connected to signal electrical contacts 4 and a reference electrical contact 5 in the form of a reference conductor extending beside the signal contacts 4. The housing block 2 is adapted to be coupled to a housing, not shown, as described in U.S. Pat. No. 4,984,992. An electrical receptacle 10 is connected to the reference conductor 5.

Figure 2:
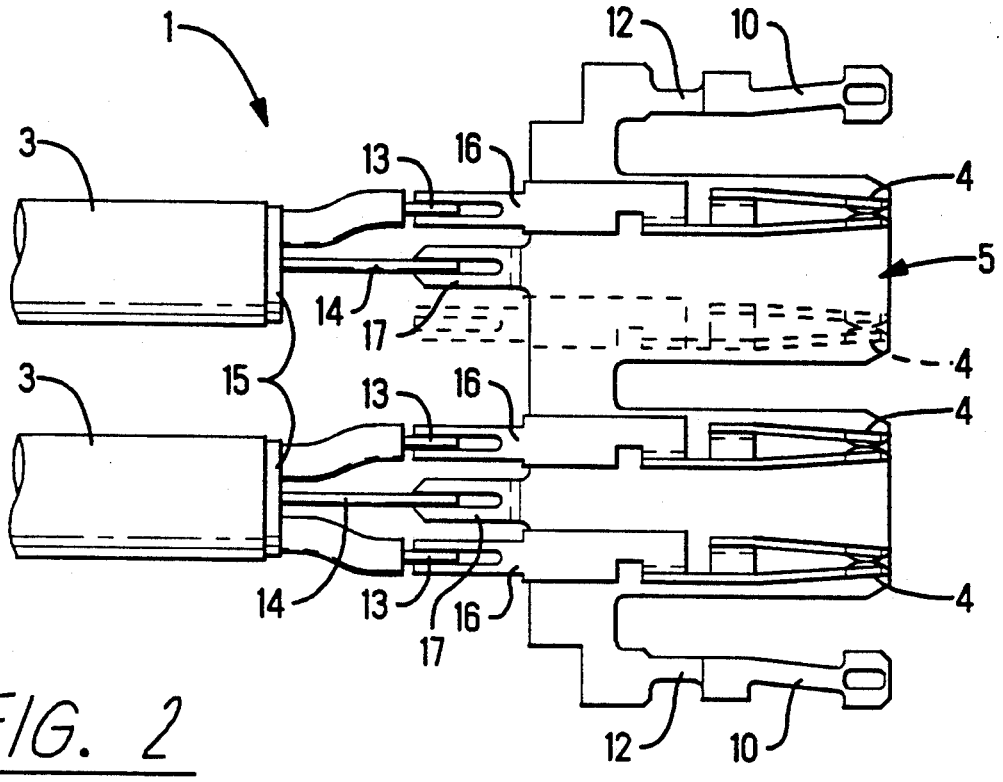
FIG. 2 is a plan view of wire connecting portions of electrical contacts connected to electrical wires.

With reference to FIG. 2, each of two representative cables 3 has at least one signal wire 13, although two signal wires 13 are shown, and at least one reference wire 14 for connection to a reference electrical potential, not shown. Each signal wire 13 is insulated, and is connected to a corresponding signal contact 4 on the housing block 2 that provides a structure for disconnectable connection of the signal wire 13. Conductive shielding 15 of the cable 3 encircles the signal wires 13 and engages the reference wire 14 that is uninsulated. The cable 3 can have other forms wherein the number or corresponding signal wires 13 varies, the number of corresponding reference wires 14 varies, and the shielding 15 may not be present, or may encircle each signal wire 13 individually. The corresponding reference wire 14 referred to herein is any conductive part of representative cable 3, such as the cable 3, intended to be connected electrically to a reference electrical potential, and comprises any of the following, a separate reference wire 14 known as a drain wire or a ground wire of the cable 3, a selected signal wire 13 of the cable 3 that is selected for connection to a reference electrical potential, or a conductive shielding 15 along the cable 3. The reference electrical potential can be electrical ground voltage or a voltage other than ground.

The reference conductor 5 is a conductive, flat metal plate having a front that projects forward at least as far as the front of each signal contact 4. The reference conductor 5 extends in a plane parallel to a row of the signal contacts 4. The reference conductor 5 extends beside each of the signal contacts 4 of the row and provides electrostatic and electromagnetic coupling across a coupling span bridging a space between each signal contact 4 and the reference conductor 5.

Figure 6:
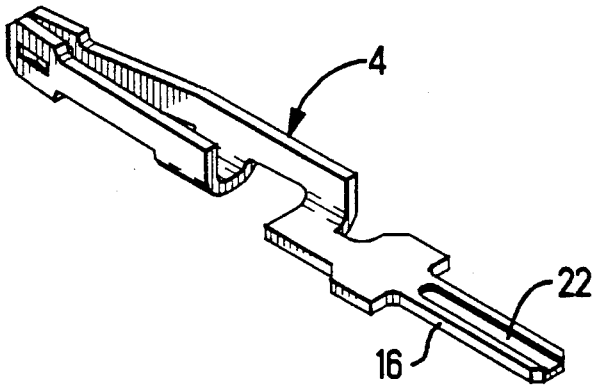
FIG. 6 is a perspective view of a signal contact.

With reference to FIGS. 2 and 6, each signal contact 4 includes a front, electrical receptacle and a rear wire connecting portion 16 connected to a conductive portion of a corresponding signal wire 13. Each corresponding reference wire 14 is connected to a corresponding wire connecting portion 17 of the reference conductor 5. Means for connection the signal wire 13 to the signal contact 4 or for connecting the reference conductor 5 to the reference wire 14 includes a weld connection.

The housing block 2 is an insulative plastics material, for example, that is injection molded or otherwise formed to cover the wire connecting portions. The signal contacts 4 and the reference conductor 5 are on the housing block 2 are held in position. The reference conductor 5 is held in position for insertion into the housing, not shown, with the signal contacts 4. Further details of the structure described is obtained by incorporation by reference to U.S. Pat. No. 4,984,992.

Figure 3:
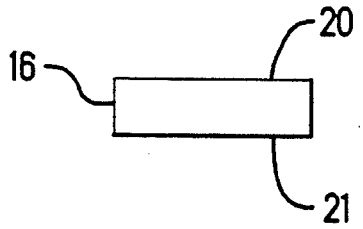
FIG. 3 is an end view of a wire connecting portion prior to formation of a cradle for an electrical wire.
Figure 4:
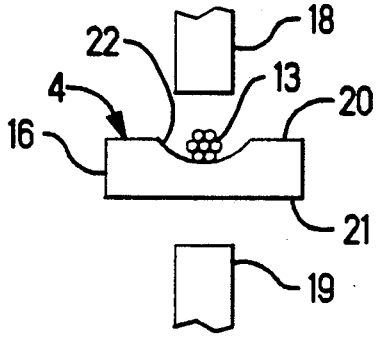
FIG. 4 is an end view of the wire connecting portion shown in FIG. 4, together with a stranded electrical wire and portions of a pair of welding electrodes.
Figure 5:
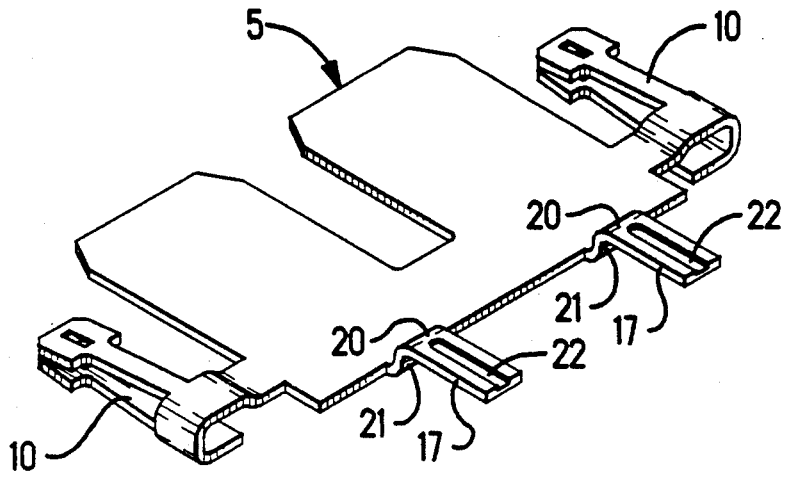
FIG. 5 is a perspective view of a reference contact.

The wire connecting portions 16, 17 of the contacts 4 and 5 are spaced apart along the housing block 2, and are constructed for being overlaid by corresponding electrical wires 13, 14, and for being welded to the corresponding wires 13, 14 by corresponding welding electrodes 18, 19, FIG. 4, of a resistance welding apparatus. Each wire connecting portion 16 has a top surface 20 and a bottom surface 21, as shown in FIG. 3, on opposite sides of a thickness of a metal sheet from which the wire connecting portion 16 has been formed. Each wire connecting portion 17 has similar surfaces 20, 21. With reference to FIGS. 1, 4, 5 and 6, the top surfaces 20 of the contacts 16, 17 have elongated recesses 22 recessed toward the bottom surfaces 21 for cradling the corresponding wires 13, 14. The wires 13, 14 can include but are not limited to wires having multiple wire strands, as shown in FIG. 4, by the representative wire 13. The recesses 22 form reduced thicknesses of the wire connecting portions 16, 17. For example, the recesses 22 are formed by indenting, as performed by coining the top surfaces 20, and thereby forming reduced thicknesses of the wire connecting portions 16, 17.

The bottom surfaces 21 of the wire connecting portions 16, 17 are constructed with shapes different from the shapes of the top surfaces 20 for conforming abutment with the surfaces of corresponding welding electrodes 19. During the coining operation, care is required not to misshape the bottom surfaces 21 on those sides of the wire connecting portions 16, 17 opposite the top surfaces 20. These bottom surfaces 21 lack deformation outwardly by formation of the recesses 22 in the top surfaces 20, and are to be constructed with exterior shapes to conform not with the shapes of the recesses 22 formed during coining, but to conform with surfaces of corresponding welding electrodes 19 to assure good electrical connection for assured transfer of electrical energy to the parts to be joined by a weld joint. For example, if the corresponding electrodes 19 are flat on the ends that abut the wire connecting portions 16, 17, the bottom surfaces 21 are substantially flat for conforming abutment with the shapes of the ends of the corresponding electrodes 19. The best results are obtained if the depth of the recess 22 is fifty per cent of the diameter of a corresponding stranded wire, having seven strands, to be received by the recess 22, and if the width of the recess 22 is two per cent greater than the diameter of such a wire. Thereby cradling of the wire is sufficient to deter unraveling of the strands, and the wire will project sufficiently above the top surface 20 for sure abutment with the corresponding electrode 18. This procedure will eliminate the need for bonding the strands together prior to welding, as was done previously according to accepted industrial practice.

With reference to FIG. 1, the wire connecting portions of the contacts 16, 17 are bent to form a series of the contacts 16, 17 in a coplanar row. The recesses 22 will then be in a common row and spaced apart such that the electrodes 18, 19 are able to construct multiple weld joints of the contacts 4, 5 with corresponding wires 13, 14.

Making an electrical connector 1 comprises the following steps, forming a recess 22 in a top surface 20 of a wire connecting portion 16, 17 of an electrical contact 4, 5 for cradling a corresponding electrical wire 13, 14 without deforming a bottom surface 21 of the wire connecting portion 16, 17 outwardly by formation of the recess 22 in the top surface 20, holding the contact 4, 5 with an insulative housing block 2, overlying the wire connecting portion 16, 17 of an electrical contact 4, 5 with the corresponding wire 13, 14, and welding the contact 4, 5 to the corresponding wire 13, 14 by welding electrodes 18, 19 of a welding apparatus.

We claim:

1. An electrical connector adapted for connection to wires having multiple wire strands comprising: an insulative housing block, electrical contacts spaced apart along the housing block, wire connecting portions of the contacts constructed for being overlaid by corresponding electrical wires each having multiple wire strands and for being welded to the corresponding wires by welding electrodes of a welding apparatus, top surfaces of the wire connecting portions having elongated recesses recessed toward bottom surfaces of the wire connecting portions for cradling the multiple wire strands of corresponding wires, and the bottom surfaces of the wire connecting portions being constructed with shapes different from the shapes of the top surfaces for conforming abutment with surfaces of corresponding welding electrodes.

2. An electrical connector as recited in claim 1, comprising: the recesses forming reduced thicknesses of the wire connecting portions.

3. An electrical connector as recited in claim 1, comprising: the recesses being formed by indenting and thereby forming reduced thicknesses of the wire connecting portions.

4. An electrical connector as recited in claim 1, comprising: the recesses being indented by coining the top surfaces.

5. An electrical connector adapted for connection to wires having multiple wire strands comprising: an insulative housing block, electrical contacts spaced apart along the housing block, wire connecting portions of the contacts constructed for being overlaid by corresponding electrical wires each having multiple wire strands and being welded to the corresponding wires by welding electrodes of a welding apparatus, top surfaces of the wire connecting portions having recesses providing cradles for the multiple wire strands of the corresponding wires, and surfaces on opposite sides of the wire connecting portions constructed with exterior shapes to conform not with the shapes of the indentations but with surfaces of corresponding welding electrodes.

6. An electrical connector as recited in claim 1, wherein a depth of each of the recesses is fifty per cent of the diameter of a corresponding wire, and a width of each of the recesses is two per cent greater than the diameter of a corresponding wire.

* * * * *